US007531998B2

(12) United States Patent
Kim

(10) Patent No.: US 7,531,998 B2
(45) Date of Patent: May 12, 2009

(54) TEMPERATURE SENSING CIRCUIT

(75) Inventor: Hyung-seuk Kim, Yangcheong-gu (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 59 days.

(21) Appl. No.: 11/850,699

(22) Filed: Sep. 6, 2007

(65) Prior Publication Data

US 2008/0061761 A1 Mar. 13, 2008

(30) Foreign Application Priority Data

Sep. 11, 2006 (KR) ..... 10-2006-0087453

(51) Int. Cl.
*G05F 3/04* (2006.01)

(52) U.S. Cl. ..... 323/312; 323/314; 323/907

(58) Field of Classification Search ..... 323/312, 323/313, 314, 315, 316, 907
See application file for complete search history.

(56) References Cited

U.S. PATENT DOCUMENTS 5,483,151 A * 1/1996 Yamashita ..... 323/312
6,225,851 B1 5/2001 Descombes
6,664,843 B2 * 12/2003 Dasgupta et al. ..... 323/312
7,087,900 B2 * 8/2006 Iida et al. ..... 250/332
7,088,085 B2 * 8/2006 Marinca ..... 323/314

FOREIGN PATENT DOCUMENTS

JP 09-184768 7/1997
JP 2005-124022 12/2005

* cited by examiner

*Primary Examiner*—Jessica Han
(74) *Attorney, Agent, or Firm*—Volentine & Whitt, P.L.L.C.

(57) ABSTRACT

A temperature sensing circuit includes first, second and third proportional to absolute temperature (PTAT) units, and first and second subtracters. The first PTAT unit generates a first output voltage based on a reference current and a current of N times the reference current, where N is an emitter current density ratio. The second PTAT unit generates a second output voltage based on a current of twice the reference current and a current of 2N times the reference current. The third PTAT unit generates a third output voltage based on the reference current and a current of N times the reference current. The first subtracter performs subtraction on the second output voltage and the third output voltage, and the second subtracter performs subtraction on an output voltage of the first subtracter and the first output voltage.

16 Claims, 6 Drawing Sheets

TEMPERATURE SENSING CIRCUIT

CROSS-REFERENCE TO RELATED PATENT APPLICATION

A claim of priority is made to Korean Patent Application No. 10-2006-0087453, filed Sep. 11, 2006, the subject mater of which is hereby incorporated by reference.

BACKGROUND OF THE INVENTION

1. Field of the Invention

The present invention generally relates to semiconductor integrated circuits, and more particularly, the present invention relates to temperature sensing circuits.

2. Description of the Related Art

FIG. 1 is a circuit diagram of a conventional temperature sensing circuit. As illustrated in FIG. 1, the conventional temperature sensing circuit includes a first current source 10 and a first diode 12 connected in series between a source voltage VDD and a ground voltage, and a second current source 14 and a second diode 16 connected in series between the source voltage VDD and the ground voltage. Each of the current sources 10 and 14 outputs a constant current $I_{ref}$. Further, an area NJ of the second diode 16 is N times larger than an area J of the first diode 12, where N is an emitter current density ratio (e.g., between the first and second diodes 12 and 16). A voltage delta $\Delta V_{BE}$ is utilized to measure temperature, and in an ideal case, $\Delta V_{BE}$ may be calculated using the following equations:

$$V_{BE1}=V_T(ln(NI_{ref}/I_S)) \quad \text{[Equation 1]}$$

$$V_{BE2}=V_T(ln(I_{ref}/I_S)) \quad \text{[Equation 2]}$$

$$\Delta V_{BE}=V_T(ln(N)) \quad \text{[Equation 3]}$$

$$V_T=kT/q \quad \text{[Equation 4]}$$

In the above equations, $V_T$ denotes thermal voltage, k is Boltzmann's constant, q denotes electron charge (constant), T denotes (absolute) temperature, $I_S$ denotes a saturation current (constant in a corresponding device) and N is an emitter current density ratio.

As illustrated in the graph of FIG. 2, in an ideal case, $\Delta V_{BE}$ is proportional to absolute temperature (PTAT). However, $\Delta V_{BE}$ actually has non-ideal effects that cause error in reading a temperature. In a non-ideal case, $\Delta V_{BE}$ is represented as follows:

$$V_{BE1}=V_T(ln(NI_{ref}+\alpha/I_S))+(NI_{ref}+\alpha)R \quad \text{[Equation 5]}$$

$$V_{BE2}=V_T(ln((I_{ref}+\beta)/I_S))+(I_{ref}+\beta)R \quad \text{[Equation 6]}$$

$$\Delta V_{BE}=V_T(ln((NI_{ref}+\alpha)/(I_{ref}+\beta))) \quad \text{[Equation 7]}$$

Here, $\alpha$ and $\beta$ represent current gains, which are dependent on temperature variations.

Non-ideal components, such as $\alpha$ and $\beta$, cause non-linear characteristics, which make it difficult to accurately sense temperature. This causes conventional temperature sensing circuits to produce erroneous temperature data.

SUMMARY OF THE INVENTION

An aspect of the present invention provides a temperature sensing circuit, including first, second and third proportional to absolute temperature (PTAT) units, and first and second subtracters. The first PTAT unit generates a first output voltage based on a reference current and a current of N times the reference current, where N is an emitter current density ratio, for example. The second PTAT unit generates a second output voltage based on a current of twice the reference current and a current of 2N times the reference current. The third PTAT unit generates a third output voltage based on the reference current and a current of N times the reference current. The first subtracter performs subtraction on the second output voltage and the third output voltage. The second subtracter performs subtraction on an output voltage of the first subtracter and the first output voltage.

The first PTAT unit may include a first current source for receiving a power supply voltage and generating the reference current; a first resistor connected in series to the first current source; and a first diode connected in series between the first resistor and a ground voltage source. The first PTAT unit may further include a second current source for receiving the power supply voltage and generating the current of N times the reference current; a second resistor connected in series to the second current source; and a second diode connected in series between the second resistor and the ground voltage source. The second diode of the first PTAT unit may have an area N times an area of the first diode. Also, the first output voltage may be a voltage $\Delta V_{BE}$ across a first node, located between the first current source and the first resistor, and a second node, located between the second current source and the second resistor.

The second PTAT unit may include a first current source for receiving a power supply voltage and generating the current of twice the reference current; a first resistor connected in series to the first current source; and a first diode connected in series between the first resistor and a ground voltage source. The second PTAT unit may further include a second current source for receiving the power supply voltage and generating the current of 2 N times the reference current; a second resistor connected in series to the second current source; and a second diode connected in series between the second resistor and the ground voltage source. The second diode of the second PTAT unit may have an area N times an area of the first diode. Also, the second output voltage may be a voltage $\Delta V_{BE}$ across a first node, located between the first current source and the first resistor, and a second node, located between the second current source and the second resistor.

The third PTAT unit may include a first current source for receiving a power supply voltage and generating the reference current; a first resistor connected in series to the first current source; and a first diode connected in series between the first resistor and a ground voltage source. The third PTAT unit may also include a second current source for receiving the power supply voltage and generating the current of N times the reference current; a second resistor connected in series to the second current source; and a second diode connected in series between the second resistor and the ground voltage source. The second diode of the third PTAT unit may have an area N times the area of the first diode. Also, the third output voltage may be a voltage $\Delta V_{BE}$ across a first node, located between the first current source and the first resistor, and a second node, located between the second current source and the second resistor.

The first subtracter may include a first differential operational amplifier for receiving the second output voltage and a second differential operational amplifier for receiving the third output voltage. A first analog-to-digital converter may receive an output of the first differential operational amplifier and convert the output to a first digital value. A second analog-to-digital converter may receive an output of the second differential operational amplifier and convert the output to a second digital value. A digital operation logic may perform subtraction on the first digital value and the second digital value. Likewise, the second subtracter may include a third differential operational amplifier for receiving the first output voltage and a fourth differential operational amplifier receiving the output voltage of the first subtracter. A third analog-to-digital converter may receive an output of the third differential operational amplifier and convert the output to a third digital value. A fourth analog-to-digital converter may receive the output of the fourth differential operational amplifier and convert the output to a fourth digital value. A digital operation logic may perform subtraction on the third digital value and the fourth digital value.

Another aspect of the present invention provides a temperature sensing circuit that effectively cancels non-linear characteristics with respect to temperature. The circuit includes multiple PTAT units for generating corresponding multiple output voltages based on a reference current. Each of the PTAT units includes a first current source, a first resistor and a first diode connected in series, and a second current source, a second resistor and a second diode connected in series. A first subtracter performs subtraction on a second output voltage and a third output voltage of the multiple output voltages. A second subtracter performs subtraction on a first output voltage of the multiple voltages and an output voltage of the first subtractor. An output voltage of the second subtracter is proportional to the temperature. A first PTAT unit and a third PTAT unit of the multiple PTAT units respectively generate the first output voltage and the third output voltage based on the reference current and a multiple of the reference current. A second PTAT unit of the multiple PTAT units generates the second output voltage based on a current of twice the reference current and the multiple of twice the reference current. Accordingly, the temperature sensing circuit has $\Delta V_{BE}$ proportional to temperature.

BRIEF DESCRIPTION OF THE DRAWINGS

The embodiments of the present invention will be described with reference to the attached drawings, in which.

DETAILED DESCRIPTION OF THE EMBODIMENTS

Figure 1:
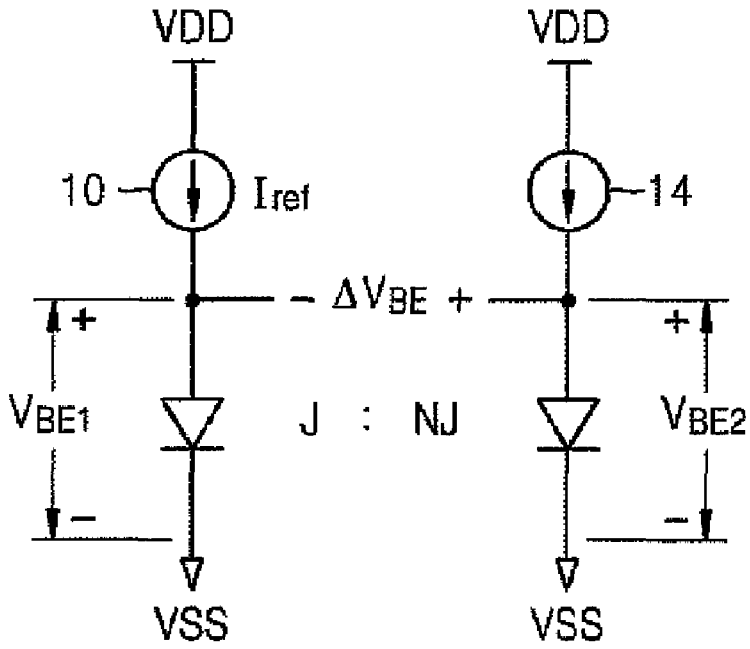
FIG. 1 (PRIOR ART)
FIG. 1 is a circuit diagram of a conventional temperature sensing circuit.
Figure 2:
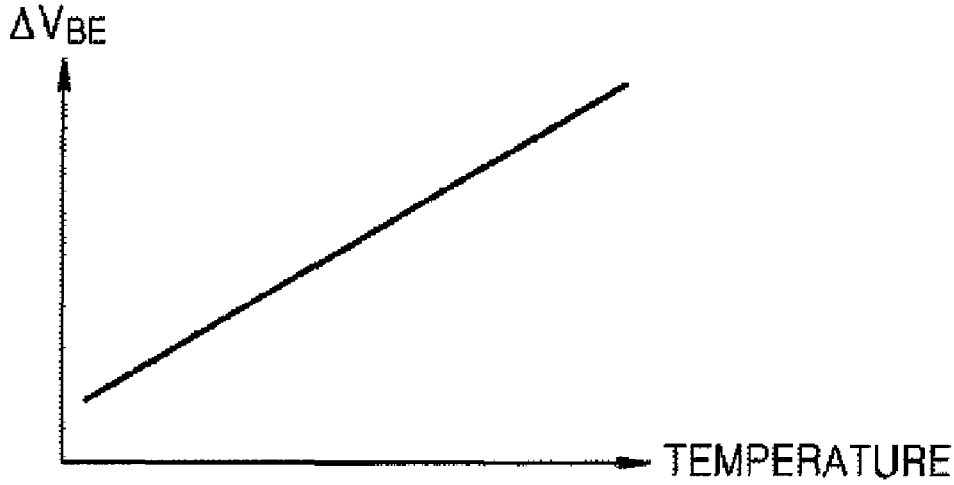
FIG. 2 (PRIOR ART)
FIG. 2 is a graph illustrating ideal $\Delta V_{BE}$ to temperature characteristics.

The present invention will now be described more fully with reference to the accompanying drawings, in which exemplary embodiments of the invention are shown. The invention, however, may be embodied in various different forms, and should not be construed as being limited only to the illustrated embodiments. Rather, these embodiments are provided as examples, to convey the concept of the invention to one skilled in the art. Accordingly, known processes, elements, and techniques are not described with respect to some of the embodiments of the present invention. Throughout the drawings and written description, like reference numerals will be used to refer to like or similar elements.

Embodiments of the present invention provide a temperature sensing circuit with non-linearity cancellation characteristics.

Figure 3:
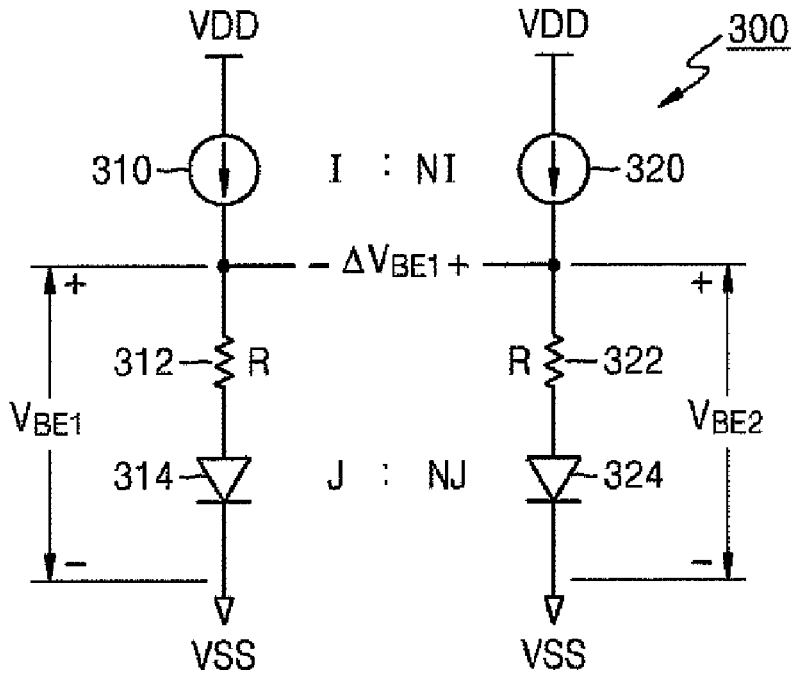
FIG. 3 is a circuit diagram of a first PTAT unit included in a temperature sensing circuit, according to an exemplary embodiment of the present invention.

FIG. 3 illustrates a first proportional to absolute temperature (PTAT) unit 300 included in a temperature sensing circuit according to an exemplary embodiment of the present invention. Referring to FIG. 3, the first PTAT unit 300 includes a first current source 310, a first resistor 312 and a first diode 314 connected in series between a first reference voltage source (for example, a power supply voltage VDD) and a second reference voltage source (for example, a ground voltage VSS). For example, a first terminal of the first current source 310 may be connected to the power supply voltage VDD, a second terminal of the first current source 310 may be connected to a first terminal of the first resistor 312, a second terminal of the first resistor 312 may be connected to a first terminal of the first diode 314, and a second terminal of the first diode 314 may be connected to a first terminal of the ground power supply voltage VSS.

In addition, the first PTAT unit 300 includes a second current source 320, a second resistor 322 and a second diode 324 likewise connected in series between the power supply voltage VDD and the ground voltage VSS. The ratio of the area J of the first diode 314 to the area NJ of the second diode 324 is 1:N. The first current source 310 generates a first reference current I, which may be proportional to temperature, and the second current source 320 generates a second reference current NI, which is N times larger than the first reference current I.

The first PTAT unit 300 of FIG. 3 may be characterized by the following equations:

$$V_{BE1} = V_T\left[\ln\left(\frac{I + \alpha T I^{\gamma}}{I_s}\right)\right] + IR \quad \text{[Equation 8]}$$

$$V_{BE2} = V_T\left[\ln\left(\frac{NI + N^{1+\varepsilon}\alpha T I^{\gamma}}{I_s}\right)\right] + NIR \quad \text{[Equation 9]}$$

$$\Delta V_{BE1} = V_T\left[\ln\left(\frac{NI + N^{1+\varepsilon}\alpha T I^{\gamma}}{I + \alpha T I^{\gamma}}\right)\right] + (N-1)IR = f_1(N, T) + f_2(N) \quad \text{[Equation 10]}$$

In the above equations, R is resistance, $\alpha$ is a current gain component approximately proportional to temperature, and $\epsilon$ and $\gamma$ are current gain components that are not proportional to temperature. For example, $\epsilon$ is greater than 0, but may be a very small value, and $\gamma$ is a value between 1 and 2 and approximates 1. Also, as discussed above, $V_T$ denotes thermal voltage, T denotes temperature, $I_S$ denotes a saturation current, and N is an emitter current density ratio.

In Equation 10, the first term $f_1(N,T)$ is represented in Taylor series as follows:

$$f_{1-\Delta VBE1}(N,T) = V_T\ln(N) + T\left(\frac{1}{N}\right)I^{\gamma-1}k_1' + T^2\left(\frac{1}{2!N^2}\right)I^{2(\gamma-1)}k_2' + \ldots \quad \text{[Equation 11]}$$

Here, $k_i$ is a constant, including $\alpha$, $\gamma$, $\epsilon$ and N.

Figure 4:
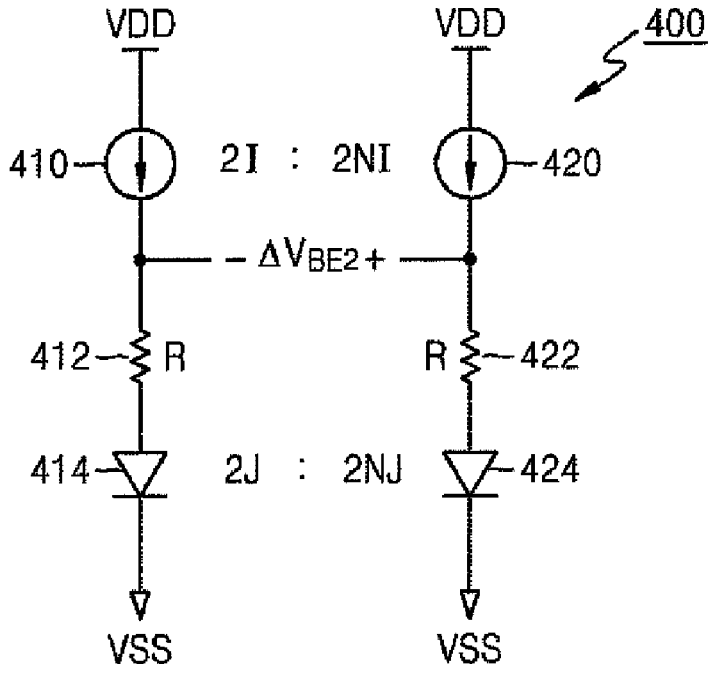
FIG. 4 is a circuit diagram of a second PTAT unit included in a temperature sensing circuit, according to an exemplary embodiment of the present invention.

FIG. 4 illustrates a second PTAT unit 400 included in the temperature sensing circuit according to an exemplary embodiment of the present invention. Referring to FIG. 4, the first PTAT unit 400 includes a first current source 410, a first resistor 412 and a first diode 414 connected in series between the power supply voltage VDD and the ground voltage VSS, and a second current source 420, a second resistor 422 and a second diode 424 connected in series between the power supply voltage VDD and the ground voltage VSS. Thus, the configuration of the second PTAT unit 400 is similar to the first PTAT unit 300 illustrated in FIG. 3, except that the ratio of the area of the first diode 414 to the area of the second diode 424 is 2J:2NJ. Also, the first current source 410 generates a current 2I, which is twice the reference current I, and the second current source 420 generates a current 2NI, which is 2N times the reference current I.

$\Delta V_{BE2}$ of the second PTAT unit 400 is represented by the following equation:

In Equation 12, the first term $f_1(N,T)$ is represented in Taylor series as follows $$\Delta V_{BE2} = V_T\left[\ln\left(\frac{NI + N^{1+\epsilon}\alpha TI^{\gamma}2^{\gamma}}{I + \alpha TI^{\gamma}2^{\gamma}}\right)\right] + 2(N-1)IR = f_1(N,T) + f_2(N) \quad \text{[Equation 12]}$$

In Equation 12, the first term $f_1(N,T)$ is represented in Taylor series as follows:

$$f_{1-\Delta VBE2}(N,T) = V_T\ln(N) + 2^{\gamma}T\left(\frac{1}{N}\right)I^{\gamma-1}k_1' + 2^{\gamma}T^2\left(\frac{1}{2!N^2}\right)I^{2(\gamma-1)}k_2' + \ldots \quad \text{[Equation 13]}$$

Equations 11 and 13 have the same ideal term, $V_T\ln(N)$, and Equation 13 has error terms almost twice the error terms of Equation 11 because the current in Equation 13 is twice the current in Equation 11.

Figure 5:
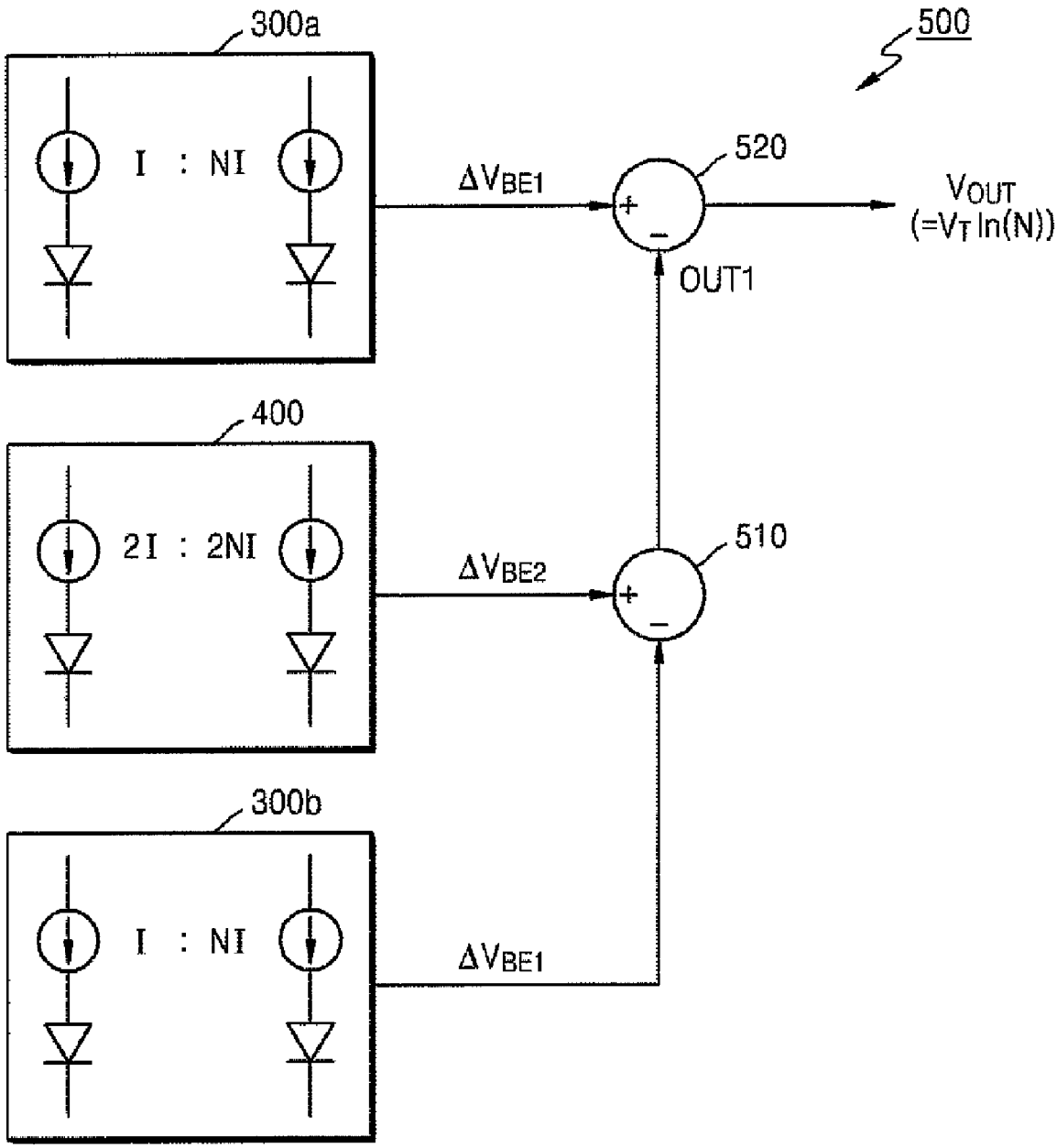
FIG. 5 is a block diagram of a temperature sensing circuit, according to an exemplary embodiment of the present invention.

FIG. 5 illustrates a temperature sensing circuit 500 according to an exemplary embodiment of the present invention. Referring to FIG. 5, the temperature sensing circuit 500 includes a first PTAT unit 300*a*, a second PTAT unit 400 and a third PTAT unit 300*b*. The first PTAT unit 300*a* and the third PTAT unit 300*b* correspond to the exemplary first PTAT unit illustrated in FIG. 3 and the second PTAT unit 400 corresponds to the exemplary second PTAT unit 400 illustrated in FIG. 4. The temperature sensing circuit 500 further includes a first subtracter 510 receiving $\Delta V_{BE2}$ of the second PTAT unit 400 and $\Delta V_{BE1}$ of the third PTAT unit 300*b*, and a second subtracter 520 receiving the output of the first subtracter 510 and $\Delta V_{BE1}$ of the first PTAT unit 300*a*.

The output voltage $V_{OUT}$ of the temperature sensing circuit 500 is represented by the following equation:

$$V_{OUT} = 2*\Delta V_{BE1} - \Delta V_{BE2} = 2*V_T\ln(N) + 2(N-1)IR + 2f_{1-\Delta VBE1}(N,T) - V_T\ln(N) - 2(N-1)IR - f_{1-\Delta VBE2}(N,T) \quad \text{[Equation 14]}$$

The first term of the output voltage $V_{OUT}$ corresponds to $V_T\ln(N)$. The error term $f_2(N)$ is removed and the error term $f_1(N,T)$ is almost removed. Accordingly, the output voltage $V_{OUT}$ is represented as follows:

$$V_{OUT} = V_T\ln(N) - 2(1-2^{\gamma-1})\left[T\left(\frac{1}{N}\right)I^{\gamma-1}k_1' + T^2\left(\frac{1}{2!N^2}\right)I^{2(\gamma-1)}k_2' + \ldots\right] \quad \text{[Equation 15]}$$

Here, the second term may be effectively ignored because $\gamma$ approximates 1. That is, the error terms of Equations 11, 13 and 15 are almost removed. Accordingly, the temperature sensing circuit 500 cancels non-linearity with respect to a temperature variation and has linear temperature characteristics. In other words, $V_{out}$ may approximate the voltage delta $\Delta V_{BE}$ in an ideal case, e.g., according to Equation 3, above: $\Delta V_{BE}=V_T(\ln(N))$.

Figure 6A:
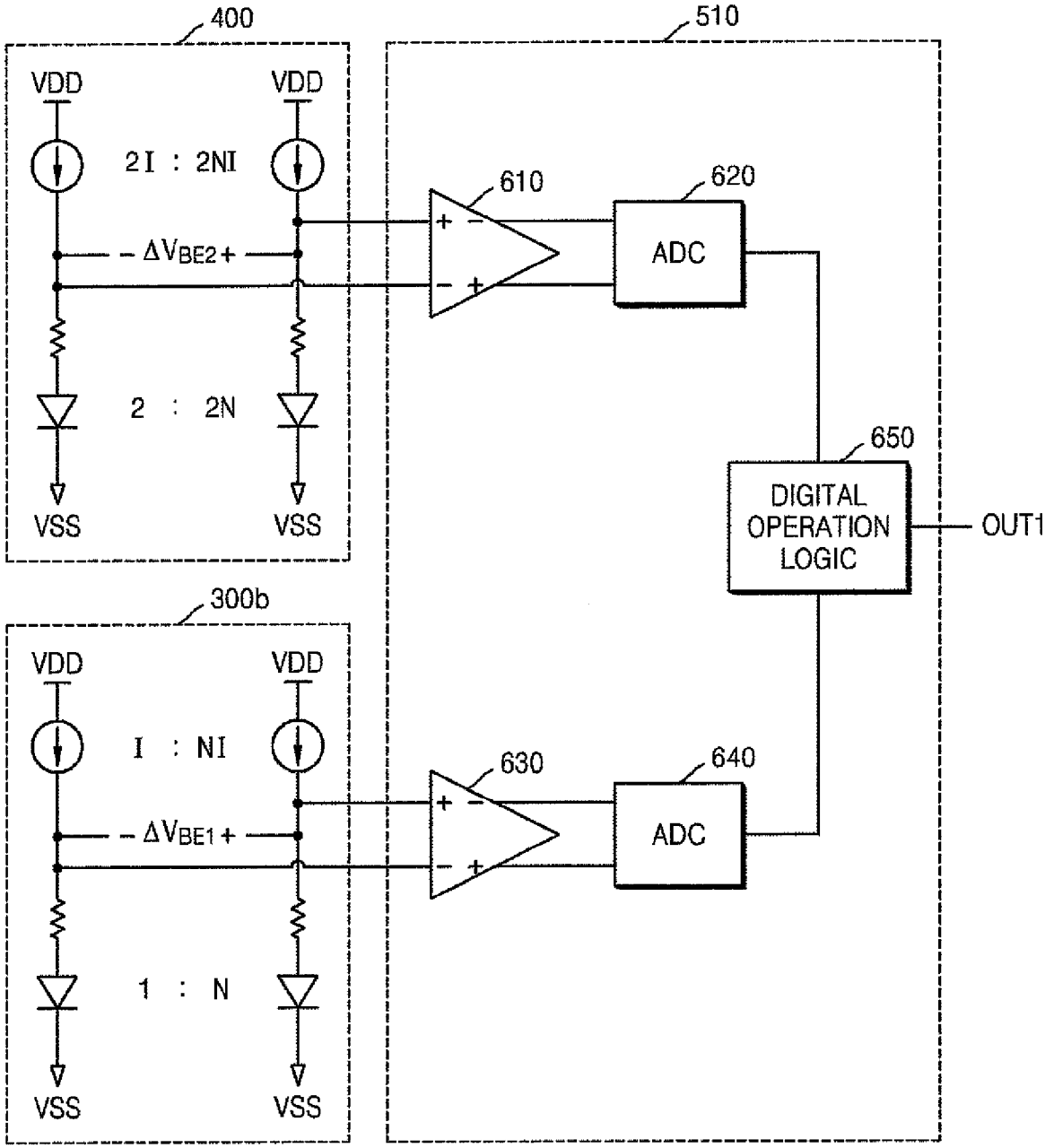
FIG. 6*a* is a block diagram of a first subtracter illustrated in FIG. 5, according to an exemplary embodiment of the present invention.
Figure 6B:
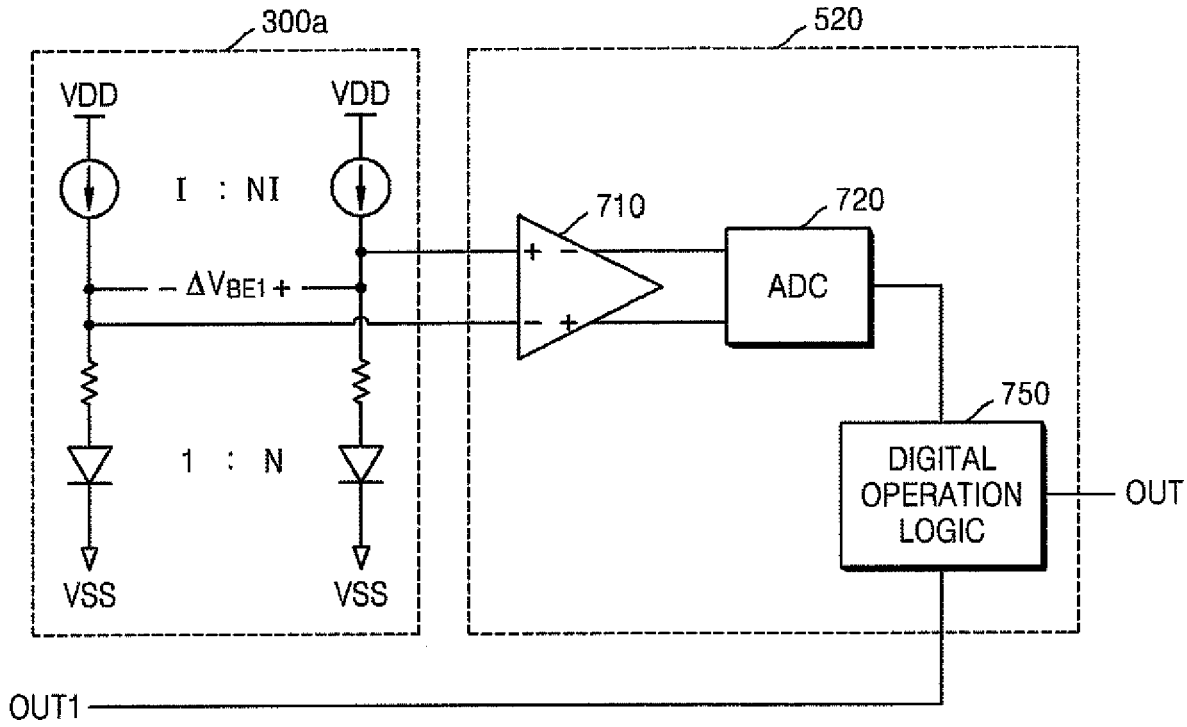
FIG. 6*b* is a block diagram of a second subtracter illustrated in FIG. 5, according to an exemplary embodiment of the present invention.

The first subtracter 510 and the second subtracter 520 have configurations as illustrated in FIG. 6*a* and FIG. 6*b*, respectively. Referring to FIG. 6*a*, the first subtracter 510 is connected to the second PTAT unit 400 and the third PTAT unit 300*b*. The $\Delta V_{BE2}$ of the second PTAT unit 400 is input to a first differential operational amplifier 610 of the first subtracter 510, and the $\Delta V_{BE1}$ of the third PTAT unit 300*b* is input to a second differential operational amplifier 630. The output voltage of the first differential operational amplifier 610 is provided to a first analog-to-digital converter 620 and converted to a first digital value. The output voltage of the second differential operational amplifier 630 is applied to a second analog-to-digital converter 640 and converted to a second digital value. The first digital value and the second digital value are provided to a digital operation logic 650. The digital operation logic 650 performs subtraction on the first digital value and the second digital value and outputs a digital value OUT1.

Referring to FIG. 6*b*, the second subtracter 520 is connected to the first PTAT unit 300*a*. The $\Delta V_{BE1}$ of the first PTAT unit 300*a* is input to a differential operational amplifier 710. The output voltage of the differential operational amplifier 710 is provided to an analog-to-digital converter 720 and converted to a digital value. The digital value of the analog-to-digital converter 720 and the digital value OUT1 of the first subtracter 510 are provided to a digital operation logic 750. The digital operation logic 750 performs subtraction on the digital value of the analog-to-digital converter 720 and the digital value OUT1 of the first subtracter 510. The output of the second subtracter 520 is $V_{OUT}$, which is indicative of a sensed temperature, discussed above.

Figure 7:
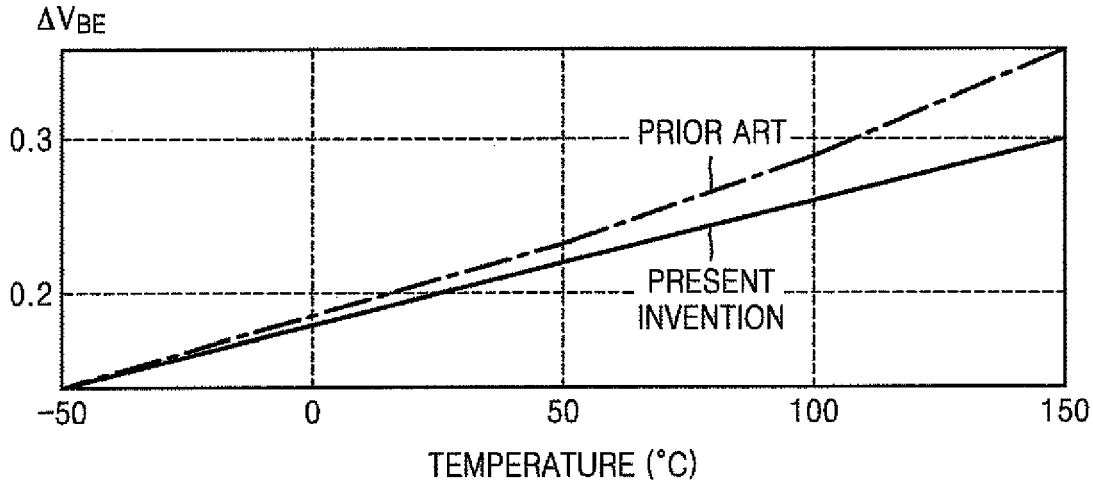
FIGS. 7, 8 and 9 are graphs illustrating temperature characteristics of the temperature sensing circuit illustrated in FIG. 5, according to exemplary embodiments of the present invention.
Figure 8:
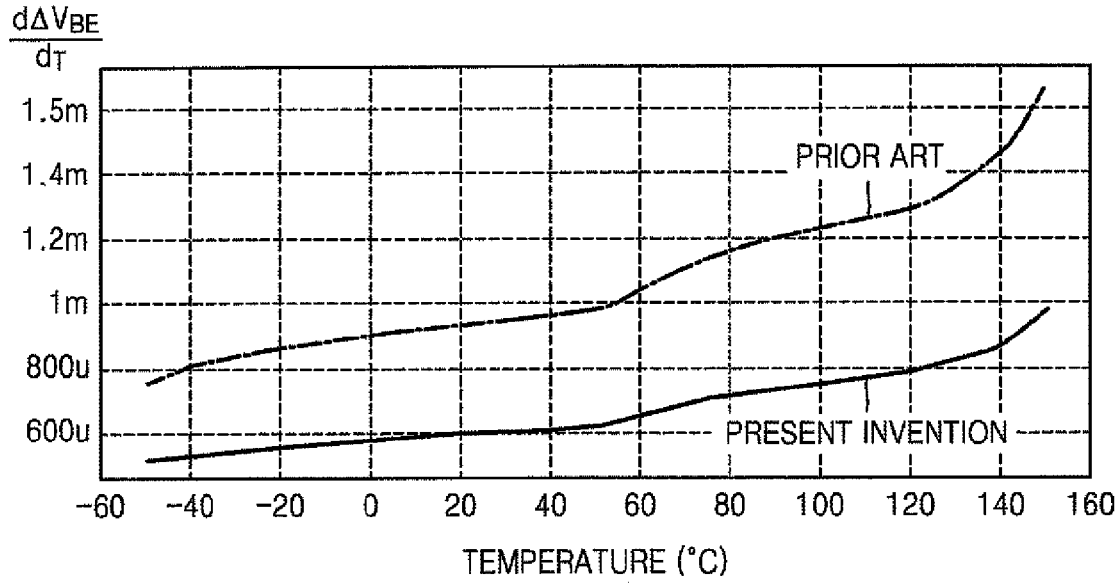
Figure 9:
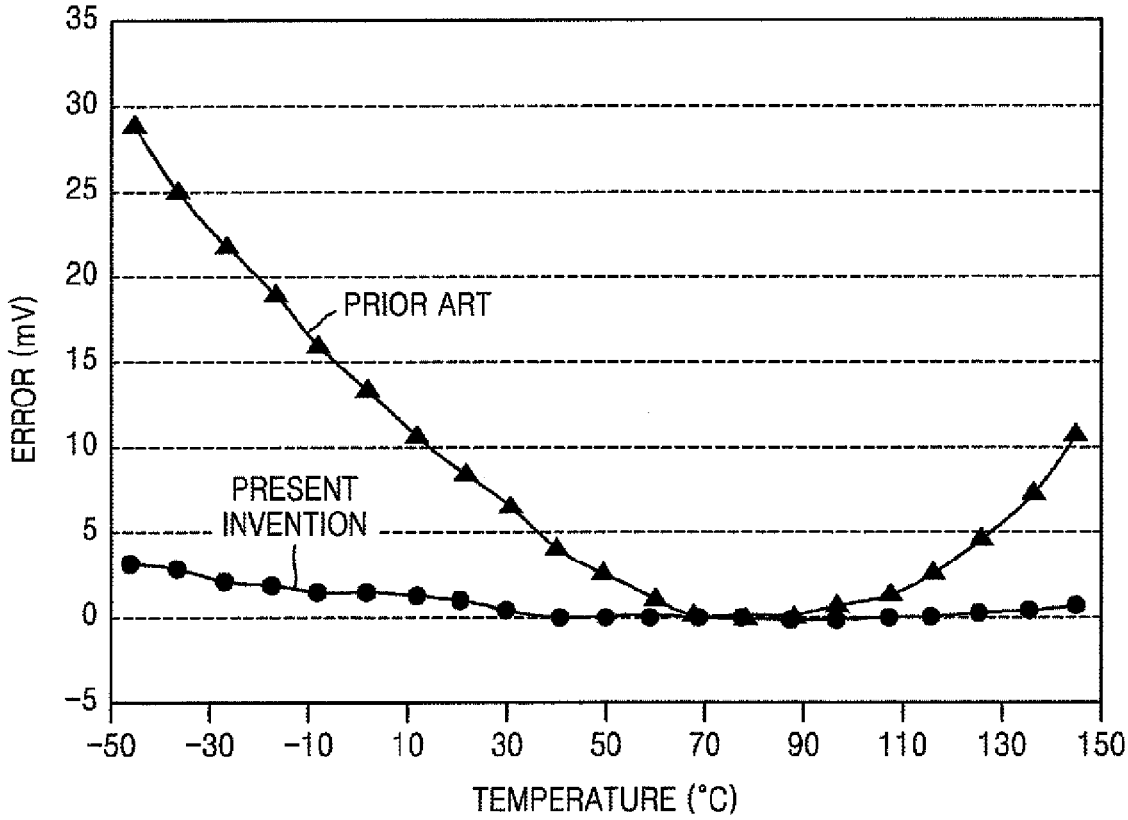

FIGS. 7, 8 and 9 are graphs illustrating temperature characteristics of the temperature sensing circuit illustrated in FIG. 5.

FIG. 7 illustrates the relationship between $\Delta V_{BE}$ and temperature. Generally, the $\Delta V_{BE}$ is linearly proportional to temperature in the temperature sensing circuit according to the present embodiment, while the $\Delta V_{BE}$ is not linearly proportional to temperature in the conventional temperature sensing circuit, e.g., as illustrated in FIG. 1. That is, the temperature sensing circuit of the present embodiment provides linear characteristics with respect to temperature variation.

FIG. 8 illustrates the relationship between $\Delta V_{BE}$ variation and temperature. The $\Delta V_{BE}$ variation in the temperature sensing circuit according to the present embodiment has a generally uniform value compared to the conventional temperature sensing circuit illustrated in FIG. 1. That is, the temperature sensing circuit of the present embodiment has linear characteristics with respect to temperature variation.

FIG. 9 illustrates error with respect to temperature. The temperature sensing circuit of the present embodiment has generally uniform error on the basis of a trimmed temperature of 80° C., for example, while the conventional temperature sensing circuit has error that varies significantly with temperature.

While the present invention has been particularly shown and described with reference to exemplary embodiments thereof, it will be understood by those of ordinary skill in the art that various changes in form and details may be made therein without departing from the spirit and scope of the present invention. Therefore, it should be understood that the above embodiments are not limiting, but illustrative.

What is claimed is:

1. A temperature sensing circuit, comprising:

a first proportional to absolute temperature (PTAT) unit for generating a first output voltage based on a reference current and a current of N times the reference current;

a second PTAT unit for generating a second output voltage based on a current of twice the reference current and a current of 2N times the reference current;

a third PTAT unit for generating a third output voltage based on the reference current and a current of N times the reference current;

a first subtracter for performing subtraction on the second output voltage and the third output voltage; and a second subtracter for performing subtraction on an output voltage of the first subtracter and the first output voltage, wherein N comprises an emitter current density ratio.

2. The temperature sensing circuit of claim 1, wherein the first PTAT unit comprises:

a first current source for receiving a power supply voltage and generating the reference current;

a first resistor connected in series to the first current source;

a first diode connected in series between the first resistor and a ground voltage source;

a second current source for receiving the power supply voltage and generating the current of N times the reference current;

a second resistor connected in series to the second current source; and a second diode connected in series between the second resistor and the ground voltage source.

3. The temperature sensing circuit of claim 2, wherein the second diode of the first PTAT unit comprises an area N times an area of the first diode.

4. The temperature sensing circuit of claim 2, wherein the first output voltage comprises a voltage $\Delta V_{BE}$ across a first node, located between the first current source and the first resistor, and a second node, located between the second current source and the second resistor.

5. The temperature sensing circuit of claim 1, wherein the second PTAT unit comprises:

a first current source for receiving a power supply voltage and generating the current of twice the reference current;

a first resistor connected in series to the first current source;

a first diode connected in series between the first resistor and a ground voltage source;

a second current source for receiving the power supply voltage and generating the current of 2 N times the reference current;

a second resistor connected in series to the second current source; and a second diode connected in series between the second resistor and the ground voltage source.

6. The temperature sensing circuit of claim 5, wherein the second diode of the second PTAT unit comprises an area N times an area of the first diode.

7. The temperature sensing circuit of claim 5, wherein the second output voltage comprises a voltage $\Delta V_{BE}$ across a first node, located between the first current source and the first resistor, and a second node, located between the second current source and the second resistor.

8. The temperature sensing circuit of claim 1, wherein the third PTAT unit comprises:

a first current source for receiving a power supply voltage and generating the reference current;

a first resistor connected in series to the first current source;

a first diode connected in series between the first resistor and a ground voltage source;

a second current source for receiving the power supply voltage and generating the current of N times the reference current;

a second resistor connected in series to the second current source; and a second diode connected in series between the second resistor and the ground voltage source.

9. The temperature sensing circuit of claim 8, wherein the second diode of the third PTAT unit comprises an area N times the area of the first diode.

10. The temperature sensing circuit of claim 8, wherein the third output voltage comprises a voltage $\Delta V_{BE}$ across a first node, located between the first current source and the first resistor, and a second node, located between the second current source and the second resistor.

11. The temperature sensing circuit of claim 1, wherein the first subtracter comprises:

a first differential operational amplifier for receiving the second output voltage;

a second differential operational amplifier for receiving the third output voltage;

a first analog-to-digital converter for receiving an output of the first differential operational amplifier and converting the output to a first digital value;

a second analog-to-digital converter for receiving an output of the second differential operational amplifier and converting the output to a second digital value; and a first digital operation logic for performing subtraction on the first digital value and the second digital value and for outputting a digital output value.

12. The temperature sensing circuit of claim 11, wherein the second subtracter comprises:

a third differential operational amplifier for receiving the first output voltage;

a third analog-to-digital converter for receiving an output of the third differential operational amplifier and converting the output into a third digital value; and a second digital operation logic performing subtraction on the third digital value and the digital out value.

13. A temperature sensing circuit for effectively canceling non-linear characteristics with respect to temperature, the circuit comprising:

a plurality of absolute temperature (PTAT) units for generating a corresponding plurality of output voltages based on a reference current, each of the PTAT units comprising a first current source, a first resistor and a first diode connected in series, and a second current source, a second resistor and a second diode connected in series;

a first subtracter for performing subtraction on a second output voltage and a third output voltage of the plurality of output voltages; and a second subtracter for performing subtraction on a first output voltage of the plurality of voltages and an output voltage of the first subtracter, an output voltage of the second subtracter being proportional to the temperature, wherein a first PTAT unit and a third PTAT unit of the plurality of PTAT units respectively generate the first output voltage and the third output voltage based on the reference current and a multiple of the reference current, and a second PTAT unit of the plurality of PTAT units generates the second output voltage based on a current of twice the reference current and the multiple of twice the reference current.

14. The temperature sensing circuit of claim 13, wherein the multiple of the reference current comprises N, where N is an emitter current density ratio.

15. The temperature sensing circuit of claim 14, wherein the second diode of each of the plurality PTAT units comprises an area N times an area of the first diode.

16. The temperature sensing circuit of claim 13, wherein each output voltage corresponding to each of the plurality of PTAT units comprises a voltage $\Delta V_{BE}$ across a first node, located between the first current source and the first resistor, and a second node, located between the second current source and the second resistor.

* * * * *